US010576760B2

(12) United States Patent
Nohara et al.

(10) Patent No.: US 10,576,760 B2
(45) Date of Patent: Mar. 3, 2020

(54) PRINTER USING ROLL PAPER

(71) Applicant: Brother Kogyo Kabushiki Kaisha, Nagoya-shi, Aichi-ken (JP)

(72) Inventors: Shuhei Nohara, Kasugai (JP); Jun Yamashiro, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 159 days.

(21) Appl. No.: 15/925,865

(22) Filed: Mar. 20, 2018

(65) Prior Publication Data

US 2019/0001712 A1 Jan. 3, 2019

(30) Foreign Application Priority Data

Jun. 28, 2017 (JP) ..... 2017-126449

(51) Int. Cl.

| | |
|---|---|
| ***B41J 11/70*** | (2006.01) |
| ***B65H 35/06*** | (2006.01) |
| ***B26D 1/30*** | (2006.01) |
| ***B41J 11/66*** | (2006.01) |
| ***B41J 15/04*** | (2006.01) |
| ***B26D 7/22*** | (2006.01) |
| ***B65H 20/02*** | (2006.01) |
| ***B41J 11/00*** | (2006.01) |
| ***B65H 35/00*** | (2006.01) |

(52) U.S. Cl.

CPC ..... *B41J 11/703* (2013.01); *B26D 1/305* (2013.01); *B26D 7/22* (2013.01); *B41J 11/0045* (2013.01); *B41J 11/663* (2013.01); *B41J 11/70* (2013.01); *B41J 15/042* (2013.01); *B65H 20/02* (2013.01); *B65H 35/0086* (2013.01); *B65H 35/06* (2013.01); *B65H 2301/41346* (2013.01); *B65H 2801/12* (2013.01)

(58) Field of Classification Search

CPC .. B26D 1/30; B26D 1/305; B41J 11/00; B41J 11/0045; B41J 11/66; B41J 11/663; B41J 11/70; B41J 11/703; B41J 15/04; B41J 15/042; B65H 20/02; B65H 35/00; B65H 35/0086; B65H 35/04; B65H 35/06; B65H 2301/41346; B65H 2801/12

See application file for complete search history.

(56) References Cited

FOREIGN PATENT DOCUMENTS

| | | | | |
|---|---|---|---|---|
| JP | 2001-287866 A | | 10/2001 | |
| JP | 2015101065 A | * | 6/2015 | ..... B41J 11/70 |

* cited by examiner

*Primary Examiner* — Nguyen Q. Ha
(74) *Attorney, Agent, or Firm* — Banner & Witcoff, Ltd.

(57) ABSTRACT

A printer has a roll of a paper and a cutter. The cutter includes a stationary blade provided and a movable blade. The movable blade is movable in an up-down direction with respect to the stationary blade between a first position and a second position. The stationary-side cutting tooth is located at a position higher than a guide surface. The movable-side cutting tooth is located, with respect to the guide surface, at a lower position when the movable blade is located at the first position, at a higher position when located at the second position, and at a third position, which is between the first and second positions, when the roll is attached to an accommodating part of the printer. When located at the third position, at least a part of the movable-side cutting tooth is located at a higher position than the lower end of the guide surface.

5 Claims, 10 Drawing Sheets

PRINTER USING ROLL PAPER

CROSS-REFERENCE TO RELATED APPLICATIONS

This application claims priority under 35 U.S.C. § 119 from Japanese Patent Application No. 2017-126449 filed on Jun. 28, 2017. The entire subject matter of the application is incorporated herein by reference.

BACKGROUND

Technical Field

The present disclosures relate to a printer using a roll paper and having a cutter to cut out the roll sheet.

Related Art

Conventionally, there is known a printer configured to nip a roll paper, which is a printing medium, with a movable blade and a stationary blade and cut out the roll sheet therewith.

SUMMARY

When the roll paper is used as the printing medium, a tip end part of the roll paper is arranged in a paper passage. Since the roll paper is generally curled, it becomes necessary to prevent the tip part of the roll paper from deviating from the paper passage. Such a printer typically has a blade setting space in which the movable blade is provided. The blade setting space extend in a direction away from the paper passage, and it is necessary to prevent the tip of the roll paper from deviating from and advancing into the blade setting space. For this purpose, according to a conventional printer using the roll paper, there is provided a cover configured to cover/uncover an entering space at which the paper passage communicates with the blade setting space, and an interlocking mechanism with which movement of the cover is interlocked with movement of the movable blade. When the movable blade is located at an initial position at which the movable blade is retracted from the paper passage, the cover is positioned to cover the entering space. In association of the movement of the movable blade from the initial position (i.e., the retracted position) to a position at which the movable blade advances into the paper passage, the cover moves from a position to cover the entering space to an open position at which the cover does not cover the entering space.

According to the above configuration, however, the printer should be provided with the cover and the interlocking mechanism to open/close the entering space, the printer needs to have a complicated structure and become upsized.

According to aspects of the present disclosures, there is provided a printer having a casing having an accommodating part configured to accommodate a roll having a roll paper, as a printing medium, wound to form the roll, the casing having an opening through which the roll is attached to the casing, a printing device configured to print an image on the roll paper, a cutter configured to cut out the roll paper in a direction crossing a conveying direction of the roll paper, and a guide member arranged on a downstream side with respect to the cutter and configured to guide the roll paper toward a discharging port, a lower surface of the roll sheet slidably contacting a guide surface of the guide member. The cutter further includes a stationary blade formed to have a planar plate shape provided with a stationary-side cutting tooth at a lower end thereof, the stationary-side cutting tooth being located higher than the guide surface, a movable blade formed to have a planar plate shape provided with a movable-side cutting tooth at an upper end thereof, the movable blade being configured to movable, in an up-down direction with respect to the stationary blade, between a first position and a second position, the movable-side cutting tooth being located at a lower position than the guide surface when the movable blade is located at the first position, the movable-side cutting tooth being located at a higher position than the guide surface when the movable blade is located at the second position. The printer further includes a driving device configured to move the movable blade, and a controller which is configured to determine whether accommodation information indicating that the roll is accommodated in the accommodating part has been generated, and cause the driving device to move the movable blade to a third position when the controller determines that the accommodation information has been generated, the third position being a position between the first position and the second position, at least a part of the movable-side cutting tooth being located at a higher position than the guide surface when the movable blade is located at the third position.

DESCRIPTION OF THE ACCOMPANYING DRAWINGS

DESCRIPTION OF THE EMBODIMENTS

Figure 1A:
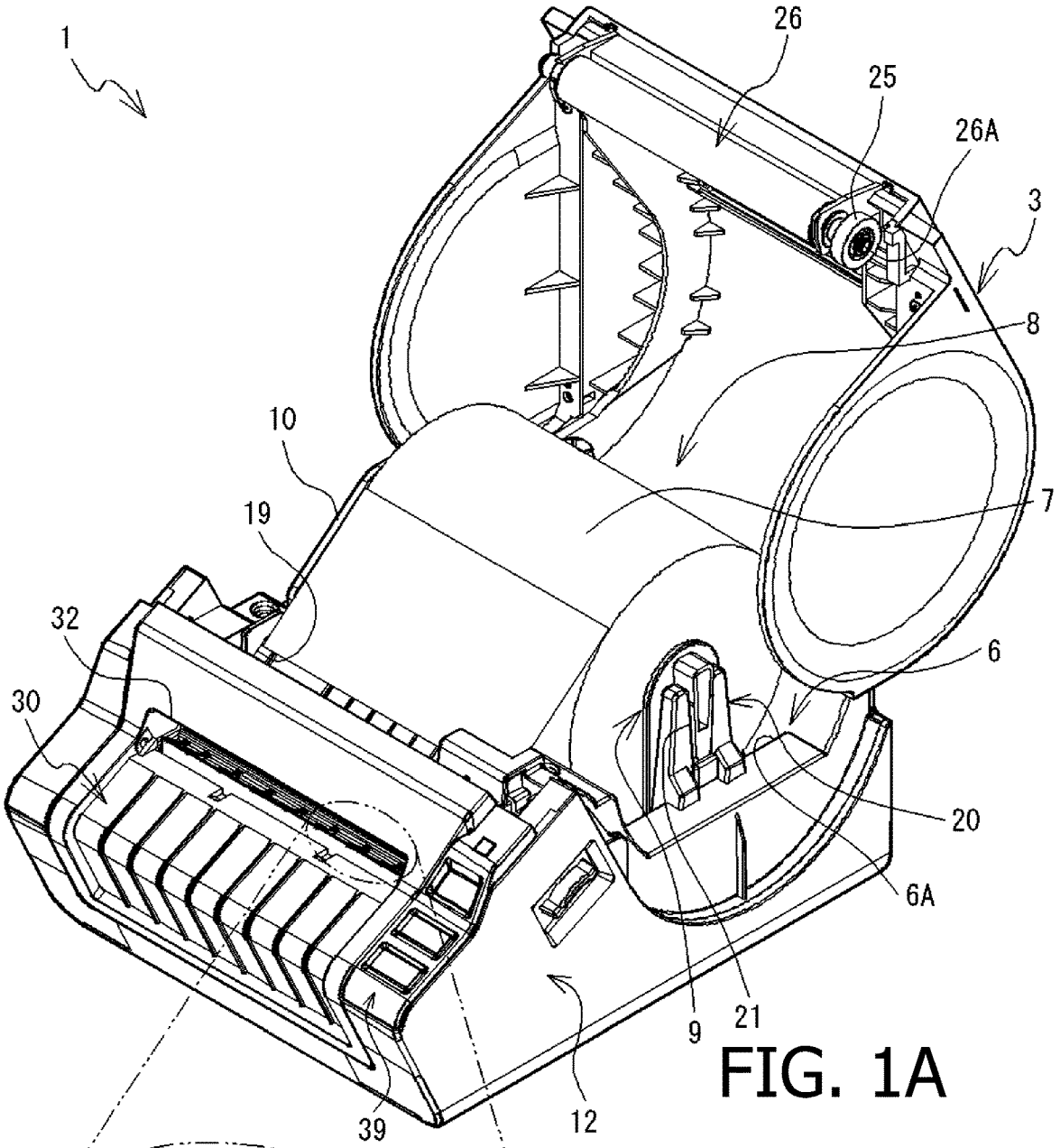
FIG. 1A is a perspective view of a printer according to an illustrative embodiment of the present disclosures.

Hereinafter, referring to the accompanying drawings, a printer 1 according to an illustrative embodiment of the present disclosures will be described. The printer 1 uses a roll 8. The roll 8 is a rolled form of a roll paper 7 which is a tape-type printing medium. According to the present embodiment, an image is printed on the roll paper 7 delivered from the roll 8, and thereafter, a portion of the roll paper 7 on which the image was printed is cut out. In the following description, right, left, front, rear, up and down directions indicated in each drawing will be referred to as the right, left, front, rear, up and down directions of the printer 1 and the roll 8.

Referring to FIGS. 1A, 1B, 2A and 2B, a configuration of the printer 1 will be described. The printer 1 has a box-like casing 12. The casing 12 has an accommodating part 6, which is a downward recess, at a rear part of the casing 12.

The accommodating part 6 has an opening 6A at which the roll 8 is accommodated. The accommodating part 6 has an attaching part 20 extending upward. The attaching part 20 has a groove 21 which is opened upward.

The roll 8 is configured such that the roll paper 7 is wound around a cylindrical winding core 4. To the winding core 4, a right holder 9 and a left holder 10 are attached. The right holder 9 and the left holder 10 rotatably support the winding core 4. The roll 8 is attached to the accommodating part 6 with the right holder 9 and the left holder 10 being attached to the winding core 4. Concretely, the right holder 9 is fitted in the groove 21 and contacts the attaching part 20 from the left side thereof, and the roll 8 is accommodated in the accommodating part 6 with its position, in the right-left direction, being adjusted. Further, a front end of the left holder 10 is fitted in a groove 19 formed on a front part of the accommodating part 6, thereby displacement of the roll 8 accommodated in the accommodating part 6 being restricted. In a state where the roll 8 is accommodated in the accommodating part 6, the winding core 4 rotates together with the roll paper 7.

At a rear end of the casing 12, a supporting shaft (not shown) rotatably supporting a cover 3 which opens/closes the opening 6A is provided. The cover 3 is configured to rotate between an opening position (see FIG. 1A) at which the cover 3 exposes the opening 6A of the accommodating part 6 to outside, and a closing position (see FIG. 2A) at which the cover 3 closes the opening 6A. At a tip end of the cover 3, a platen roller 26 extending in the right-left direction is supported. At a right end of a shaft 26A of the platen roller 26, a roller gear 25 is fixed.

At a central part, in a font-rear direction, of the casing 12, a head supporter 28 is provided so as to be movable in an up-down direction. The head supporter 28 is urged upward by a spring 24. On an upper surface of the head supporter 28, a plate-shaped head 29 containing a plurality of heat generating members (not shown) is fixed. When the cover 3 is rotated to the closing position, the platen roller 26 pushes the head 29 downward from the up side thereof against the urging force of the spring 24. At this stage, the roller gear 25 engages with a gear train (not shown) provided inside the casing 12, thereby the roller gear 25 being connected with a conveying motor 22 (see FIG. 4) accommodated inside the casing 12.

At a position displaced from the head supporter 28 in the right-left direction, a detector 11 (see FIG. 4) is provided. According to the present embodiment, as an example, the detector 11 is a leaf switch provided on a left side with respect to the head supporter 28. When the cover 3 is located at the closing position, the cover 3 contacts the detector 11, and the detector generates an ON signal. When the cover 3 rotates from the closing position toward the opening position, the cover 3 is separated from the detector 11 and the detector 11 generates an OFF signal. As above, the detector 11 detects whether the cover 3 is located at the closing position or not, and generates the ON signal or OFF signal depending on the detection result. According to the present embodiment, the ON signal of the detector 11 is a signal representing that the opening 6A is closed, while the OFF signal is a signal representing that the opening 6A is opened (i.e., exposed to outside).

On a front side with respect to the head supporter 28, a guide plate 23 (see FIG. 2A) is provided. The guide plate 23 is a plate member extending horizontally (in the right-left direction), and is configured to guide the roll paper 7 frontward. On the front side with respect to the guide plate 23, a cutter section 100 (described later) is provided. A front cover 30 covering a front part and an upper part of the cutter section 100 is attached to the casing 12. The front cover 30 is formed with a discharging port 32 through which the roll paper 7 is discharged. The discharging port 32 is a rectangular opening extending in the right-left direction. Below the discharging port 32, a guiding member 31 is provided. According to the present embodiment, the guiding member 31 is attached to a front frame 98 (described later). The guiding member 31 extends in the right-left direction, of which length is substantially the same as a width (i.e., a length in the right-left direction) of the discharging port 32. The guiding member 31 is configured to guide the roll paper 7, which is guided frontward by the guide plate 23, toward the discharging port 32.

Figure 1B:
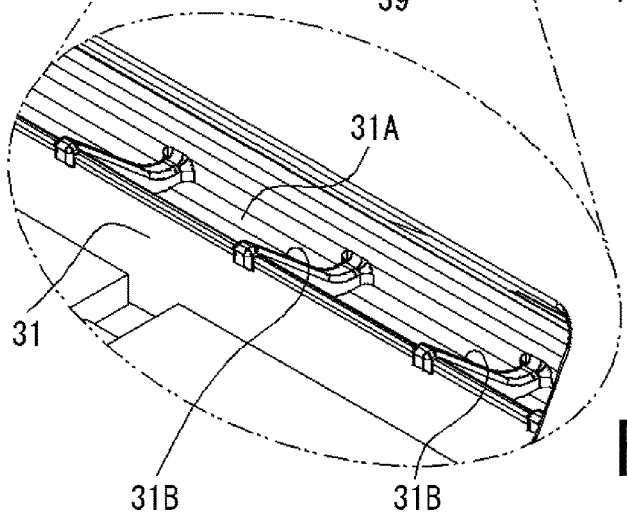
FIG. 1B is an enlarged view of a circled portion of FIG. 1A.
Figure 1B:
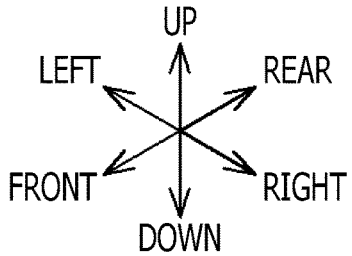

On an upper surface 31A of the guiding member 31, a plurality of ribs is formed at regular intervals (see FIGS. 1A and 1B). The plurality of ribs has the same shape. An upper surface of each rib serves as a guiding surface 31B which slidably contacts a lower surface of the roll paper 7. The guide surface 31B includes a curved surface which is on a rear side and slightly curved (concaved) downward, and a planar surface extending in an upper frontward direction from a front end of the curved surface toward the discharging part 32. A longitudinal direction of the guide surface 31B is inclined with respect both the up-down direction and the front-rear direction, and a shorter side direction of the guide surface 31B is the right-left direction (see FIG. 1A). The guide surface 31B is arranged at a lower level than the upper surface of the guide plate 23.

On a right side with respect to the front cover 30, an operation panel 39 is arranged. According to the present embodiment, the operation panel 39 includes a plurality of buttons including a power button, a mode switching button and the like. The user can input various instructions by operating the plurality of buttons provided to the operation panel 39.

Next, referring to FIGS. 2 and 3, the cuter section 100 will be described in detail. The cutter section 100 is a mechanism configured to nip the roll paper 7 located between the guide plate 23 and the guiding member 31 and cut out the same. The cutter section 100 includes a rear frame 99, a stationary blade 101, a movable blade 105, a font frame 98, a gear 95 and a cutting motor 91 (see FIG. 4).

The rear frame 99 is a plate member extending in the up-down direction between the guiding member 31 and the guide plate 23, and fixed to a lower part of the casing 12. The rear frame 99 extends to a position higher than the guide plate 23. At a substantially central port, in the up-down direction, of the rear frame 99, a passing hole 99A having a rectangular shape elongated in the right-left direction is formed so as to allow the roll paper 7 to pass therethrough. A front end part of the guide plate 23 is inserted in the passing hole 99A (see FIG. 2B). On a lower side with respect to the passing hole 99A, a circular hole 99B pierced in the front-rear direction is formed. The stationary blade 101 is formed to have a planar plate shape having a thickness in the front-rear direction, and is fixed to the front surface of the upper part of the rear frame 99. The stationary blade 101 is arranged on an upper front side with respect to the guide plate 23. At the lower end of the stationary blade 101, a stationary-side cutting tooth 104 is formed. The stationary-side cutting tooth 104 extends linearly in the right-left direction at a position higher than the guide surface 31B. It is noted that the direction in which the stationary-side cutting tooth 104 extends is substantially parallel to an imaginary surface connecting the planar parts of the plurality of guide surfaces 31B.

The movable blade 105 is formed to have a planar plate shape having a thickness in the front-rear direction and supported by the rear frame 99 so as to be movable in the up-down direction. On a lower side with respect to the movable blade 105, a long hole 105 extending in the right-left direction is formed. The long hold 105A is pierced in the front-rear direction and is arranged at a position to face the circular hole 99B of the rear frame 99 from the front side thereof. At an upper end of the movable blade 105, a movable-side cutting tooth 106 is formed. The movable-side cutting tooth 106 includes a first inclined blade part 106A and a second inclined blade part 106B. The first inclined blade part 106A and the second inclined blade part 106B are substantially symmetric in the right-left direction and each extends linearly. Specifically, the first inclined blade part 106A inclines downward from a right side to a left side, while the second inclined blade part 106B inclines upward from the right side to the left side.

Figure 9:
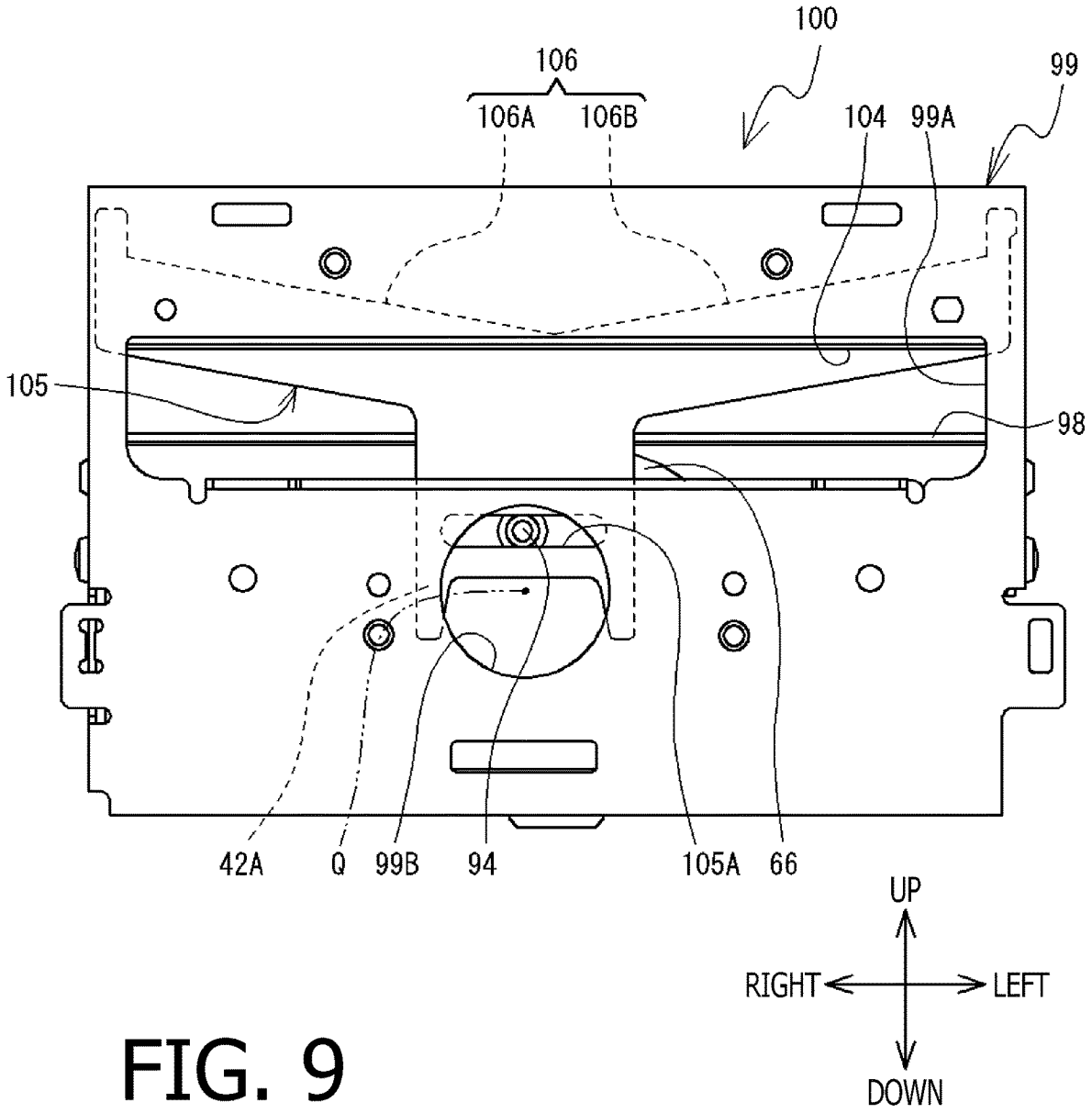
FIG. 9 is a rear view of the cutter section when the movable blade is located at a second position.

The movable blade 105 moves, in the up-down direction, between a first position (see FIG. 3) and a second position (see FIG. 9). The first position is a lower end of a movable range of the movable blade 105, which the second position is an upper end of the movable range of the movable blade 105. When the movable blade 105 is located at the first position, the movable-side cutting tooth 106 is located at a position lower than the guide surface 31B. When the movable blade 105 is located at the second position, the movable-side cutting tooth 106 is located at a position higher than the stationary-side cutting tooth 104. During a process of the movable blade 105 moving up from the first position to the second position, the movable-side cutting tooth 106 slides with respect to the stationary blade 101 and nips the roll paper 7 between the movable-side cutting tooth 106 and the stationary-side cutting tooth 104. It is noted that the movable range of the movable blade 105 includes a third position which is a position at a particular height (see FIG. 7).

A positional relationship, in the up-down direction, between the movable-side cutting tooth 106 and the guide surface 31B when the movable blade 105 is located at the third position will be described. Since the guide surface 31B includes the curved surface and the planar surface as described above, a lower end of the planar surface will be referred to as a lower end of the guide surface 31B for the sake of description. A right part (i.e., a part in the vicinity of a right end) of the first inclined blade part 106A is located at a higher position than the lower end of the guide surface 31B, and a left part (i.e., a part in the vicinity of a left end) of the first inclined blade part 106A is located at a lower position than the lower end of the guide surface 31B. Similarly, a left part (i.e., a part in the vicinity of a left end) of the second inclined blade part 106B is located at a higher position than the lower end of the guide surface 31B, and a right part (i.e., a part in the vicinity of a right end) of the second inclined blade part 106B is located at a lower position than the lower end of the guide surface 31B (see FIG. 7). It is noted that the lower end of the guide surface 31B is indicated by two-dotted lines in FIG. 7.

Figures 2A, 2B:
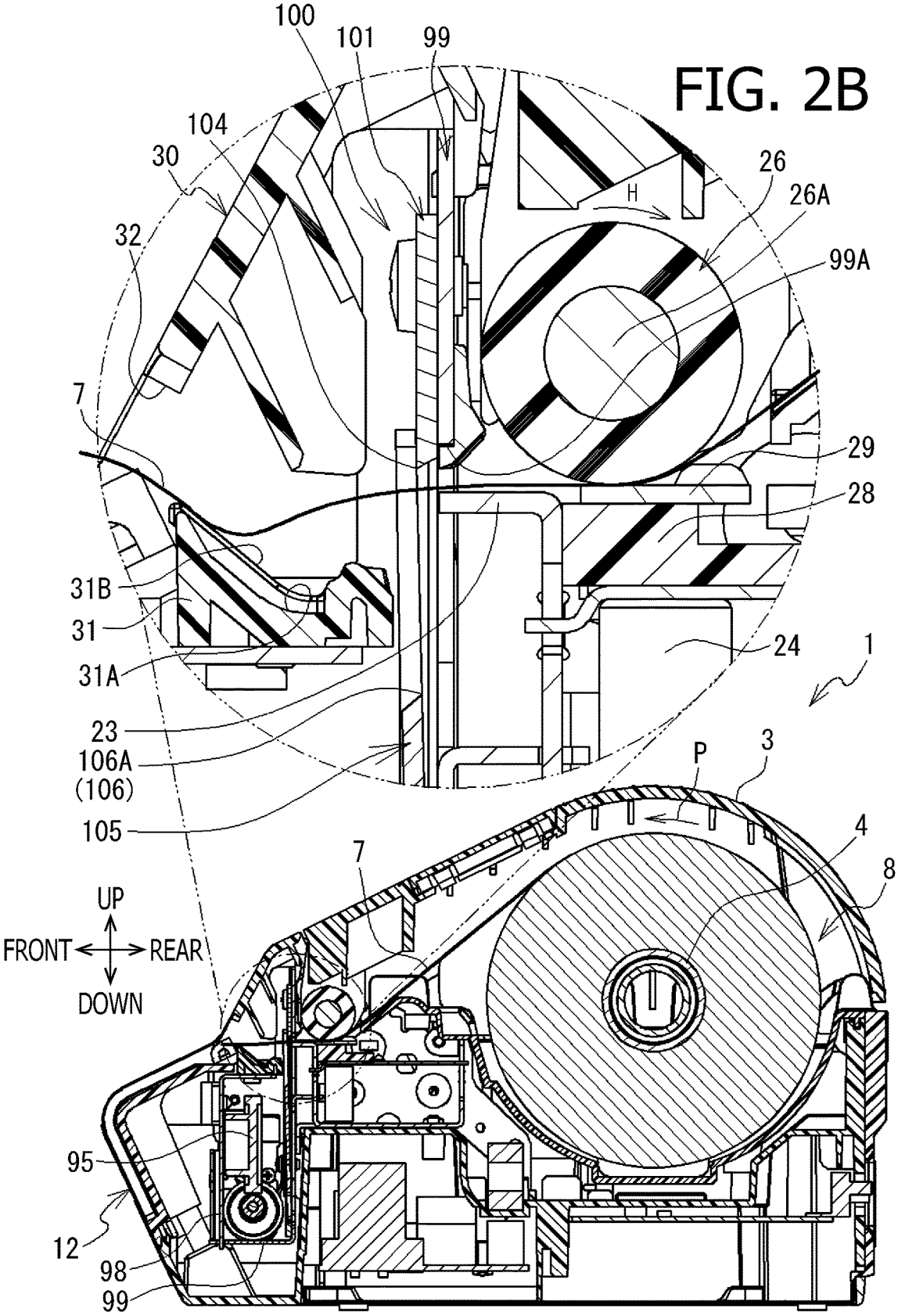
FIG. 2A is a cross-sectional side view of the printer.
FIG. 2B is an enlarged view of a circled portion of FIG. 2A.
Figure 3:
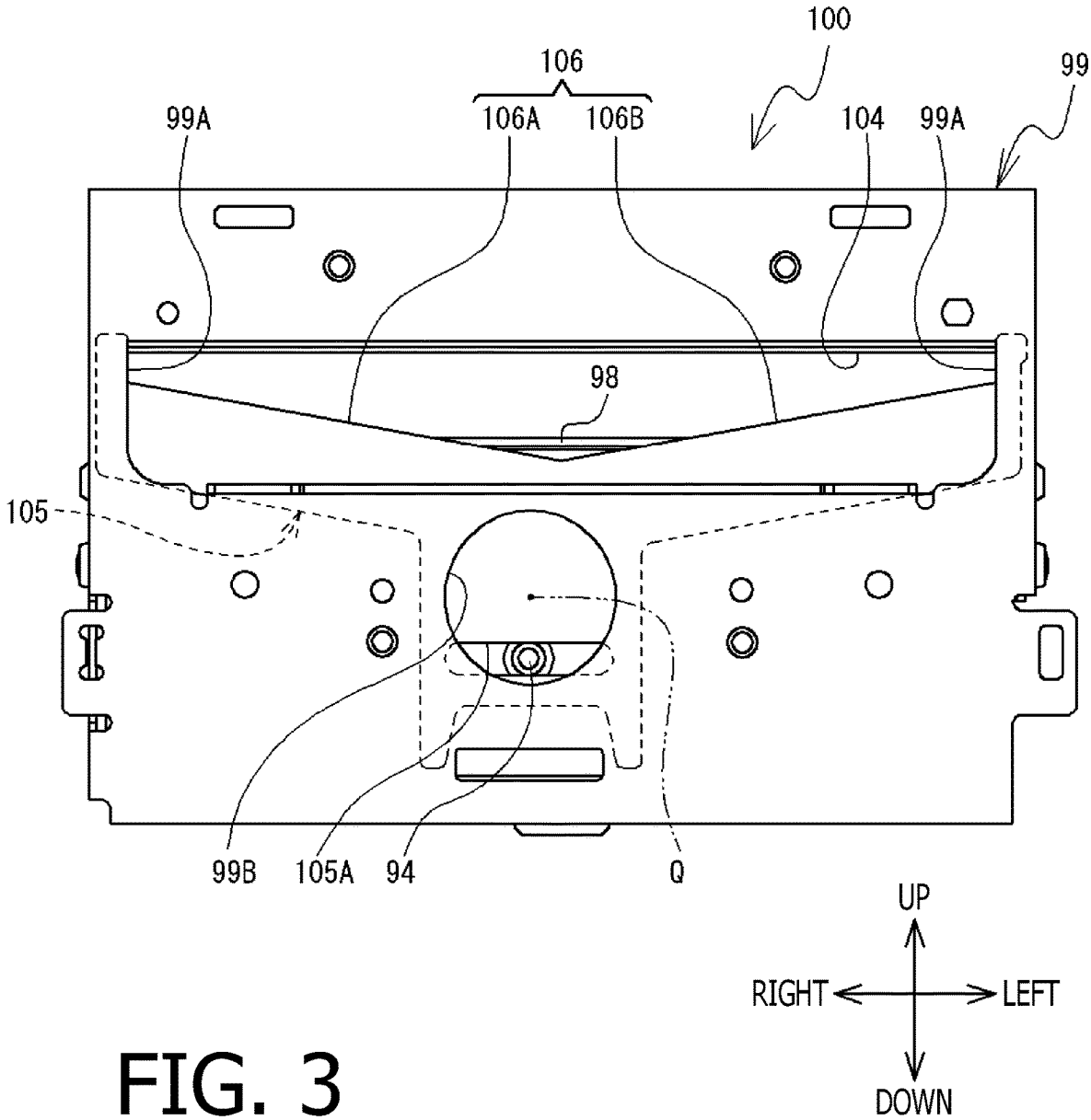
FIG. 3 is a rear view of a cutter section in a state where a movable blade is located at a first position.

As shown in FIGS. 2A, 2B and 3, the front frame 98 is a plate member fixed on a front side of the rear frame 99. At a substantially central part of the front frame 98, a gear 95, which has a circular shape in front view (see FIGS. 2A and 2B) is rotatably supported. A center of rotation of the gear 95 is an axis Q extending in the front-rear direction. The gear 95 has a pin 94 protruding rearward. The pin 94 is slidably fitted in the long hole 105A of the movable blade 105, and also inserted in a circular hole 99B of the rear frame 99. A center of the circular hole 99B is on the axis Q. The cutting motor 91 (see FIG. 4) is fixed to the front frame 98. The cutting motor 91 causes the gear 95 to rotate through a not shown gear. When the cutting motor 91 is driven to rotate the gear 95, the pin 94 rotates in association with rotation of the gear 95. Then, the pin 94 slides with respect to the long hole 105A with rotationally moving inside the circular hole 99B, thereby the movable blade 105 moving in the up-down direction between the first position and the second position.

Figure 4:
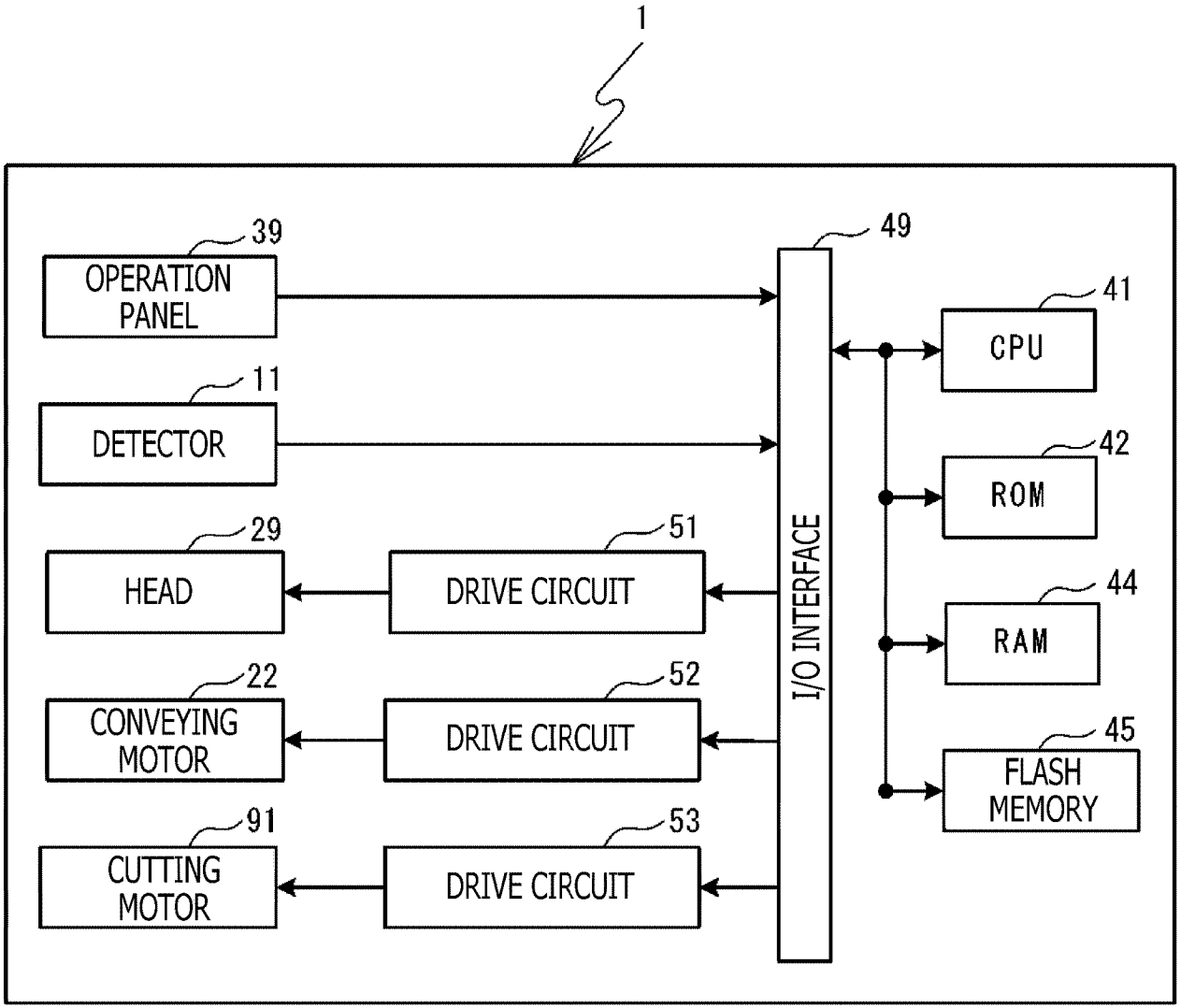
FIG. 4 is a block diagram showing an electrical configuration of the printer.

Next, referring to FIG. 4, an electrical configuration of the printer 1 will be described. The printer 1 has a CPU 41. The CPU 41 integrally controls operations of the printer 1. The CPU 41 is connected to a ROM 42, a RAM 44, a flash memory 45 and an I/O interface 49. The ROM 42 stores various programs. The RAM 44 and the flash memory 45 permanently or temporarily stores various pieces of information necessary for operations of the printer 1.

The CPU 41 is connected to the operation panel 39, the detector 11 and the driving circuits 51-53 through the I/O interface 49. The operation panel 39 transmits various instructions which are generated in accordance with input operations by the user to the CPU 41. The detector 11 transmits an ON signal or an OFF signal to the CPU 41. The driving circuit 51 is connected to the head 29, the driving circuit 52 is connected to the conveying motor 22 and the driving circuit 53 is connected to the cutting motor 9. The CPU 41 controls the head 29, the conveying motor 22 and the cutting motor 91 by transmitting control signals to the driving circuits 51-53, respectively.

Next, referring to FIGS. 2A, 2B, 5-9, a first main process will be described. The first main process is a process causing the printer 1 to execute a printing operation and a cutting operation. Before the first main process is started, the roll 8 is not attached to the printer 1, and the cover 3 is located at the closing position. When the user operates the operation panel 39 to power on the printer 1, the CPU 41 starts executing the main process.

As shown in FIGS. 5-8, the CPU 41 monitors a detection result of the detector 11 during a particular period and determines whether the cover 3 is located at the opening position or not (S1). For example, when the detector 11 keeps outputting the ON signal for a particular time period (e.g., for five seconds), the CPU 41 determines that the cover 3 is not located at the opening position (S1: NO). In contrast, when the detector 11 outputs at least once during the particular time period, the CPU 41 determines that the cover 3 is located at the opening position (S1: YES).

When the user rotates the cover 3 to move from the closing position to the opening position, the detector 11 transmits the OFF signal to the CPU 41 (S1: YES). Then, the CPU 41 controls the cutting motor 9 to move up the movable blade 105 from the first position to the third position (S3). At this stage, a right part of the first inclined blade part 106A and a left part of the second inclined blade part 106B are located at higher position that the lower end of the guide surface 31B (see FIGS. 6 and 7). Based on the detection result of the detector 11, the CPU 41 determines whether the cover 3 is located at the closing position (S5). Until the cover is rotated to reach the closing position (S5: NO), the CPU 41 operates in a standby state.

Figure 6:
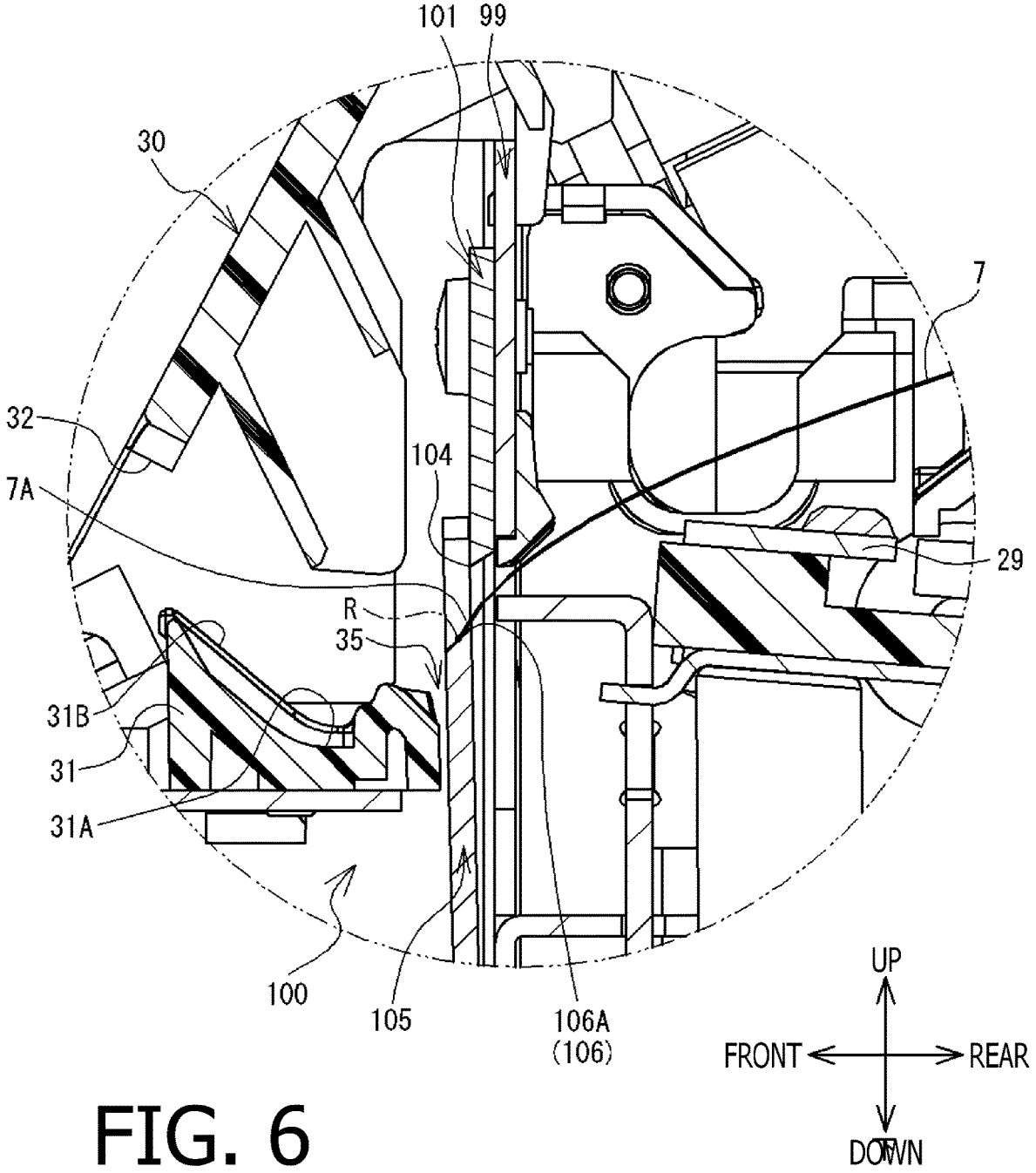
FIG. 6 is a cross-sectional partial side view of a movable-side cutting tooth in a state where the movable blade is located at a third position.
Figure 7:
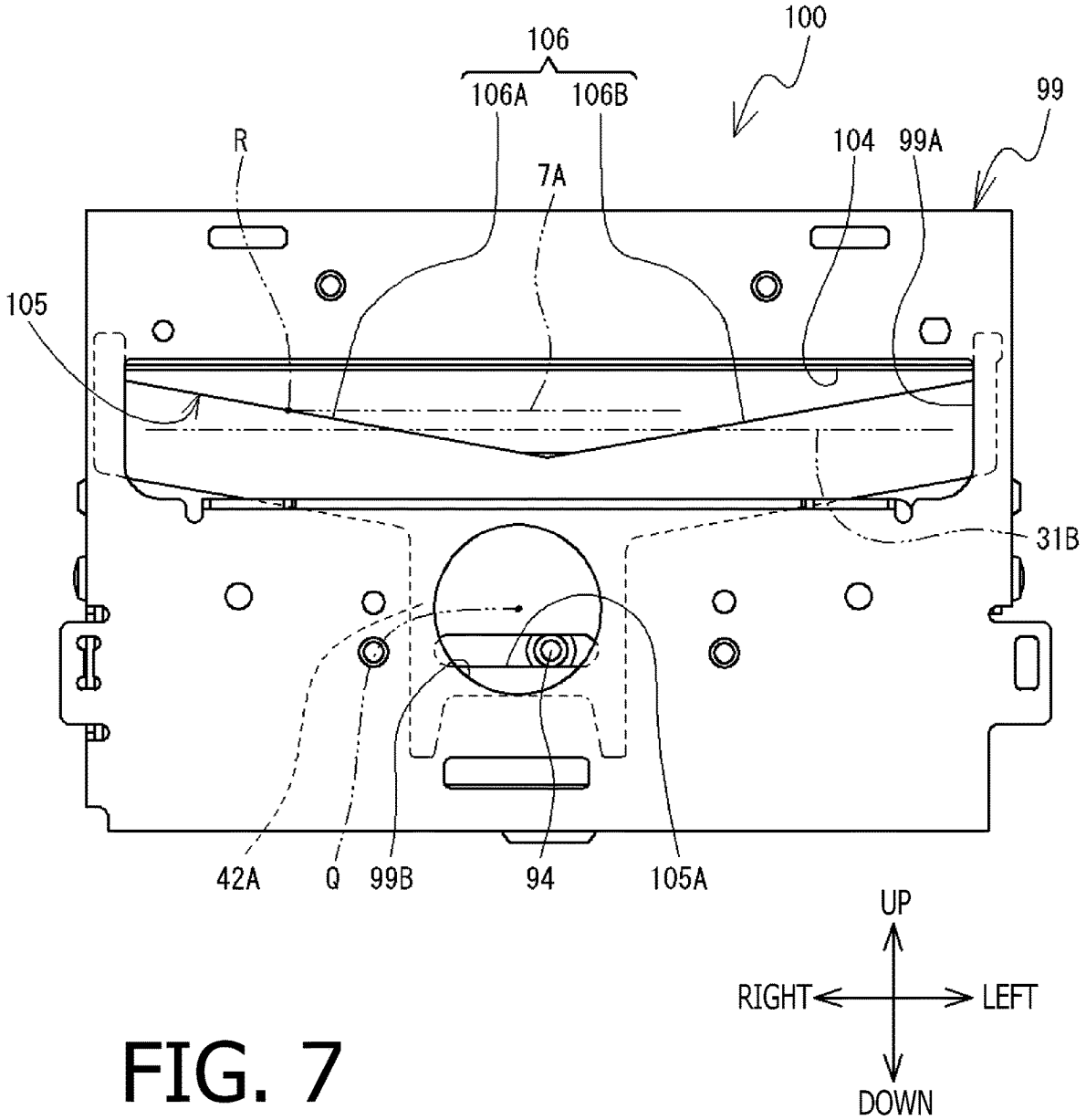
FIG. 7 is a rear view of the cutter section when the movable blade is located at the third position.
Figure 8:
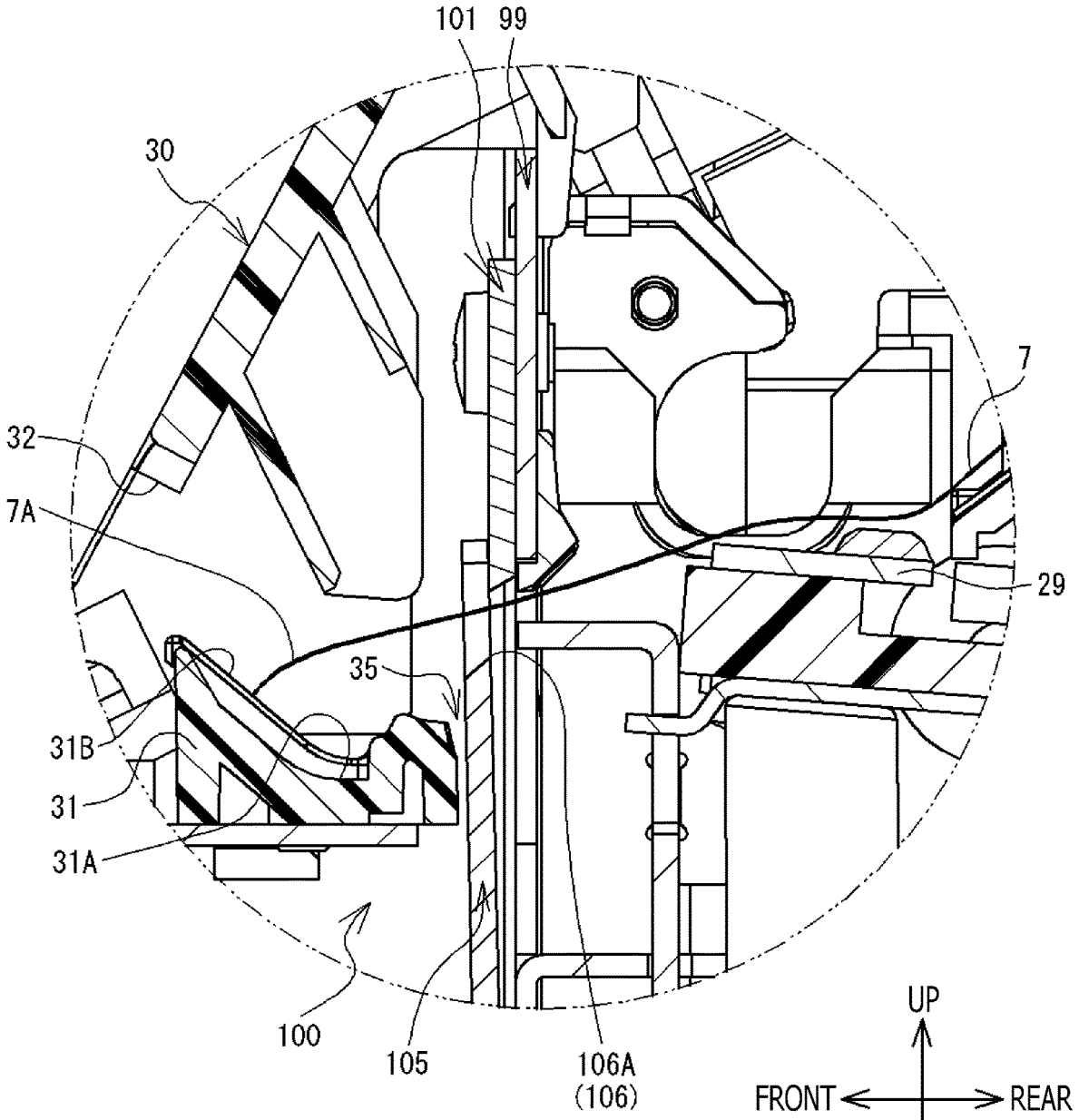
FIG. 8 is a cross-sectional partial side view in a state where a tip part of a roll paper has reached a guide surface.

As shown in FIGS. 2, 6 and 7, when the CPU 41 operates in the standby state (S5: NO), the user places the roll 8 at the accommodating part 6, and rotates the roll 8 counterclockwise in right-side view (in a direction of arrow P in FIG. 2A). Then, the user moves a tip part 7A of the roll paper 7 delivered from the roll 8 toward the guide surface 31B. At this stage, due to a curving tendency of the roll sheet 7, the tip part 7A may be curved downward. In such a case, a right end part of the tip part 7A which is moving toward the guide surface 31B via the guide plate 23 contacts the first inclined blade part 106A of the movable blade 105 located at the third position and is supported thereby. A contact point between the first part 7A and the first inclined blade part 106A is a point R shown in FIGS. 6 and 7. Since the tip part 7A is smoothly transferred from the guide plate 23 to the guide surface 31B by the movable-side cutting tooth 106, the tip part 7A is not caught by a clearance 35 between the movable blade 105 and the guiding member 31.

When the user causes the tip part 7A to pass through the discharging part 32, setting of the roll paper 7 is completed. As the user rotates the cover 3 to the closing position, a platen roller 26 and a head 29 nip the roll paper 7 (see FIG. 2B), and the detector 11 outputs, instead of the OFF signal, the ON signal (S5: YES).

Figure 5:
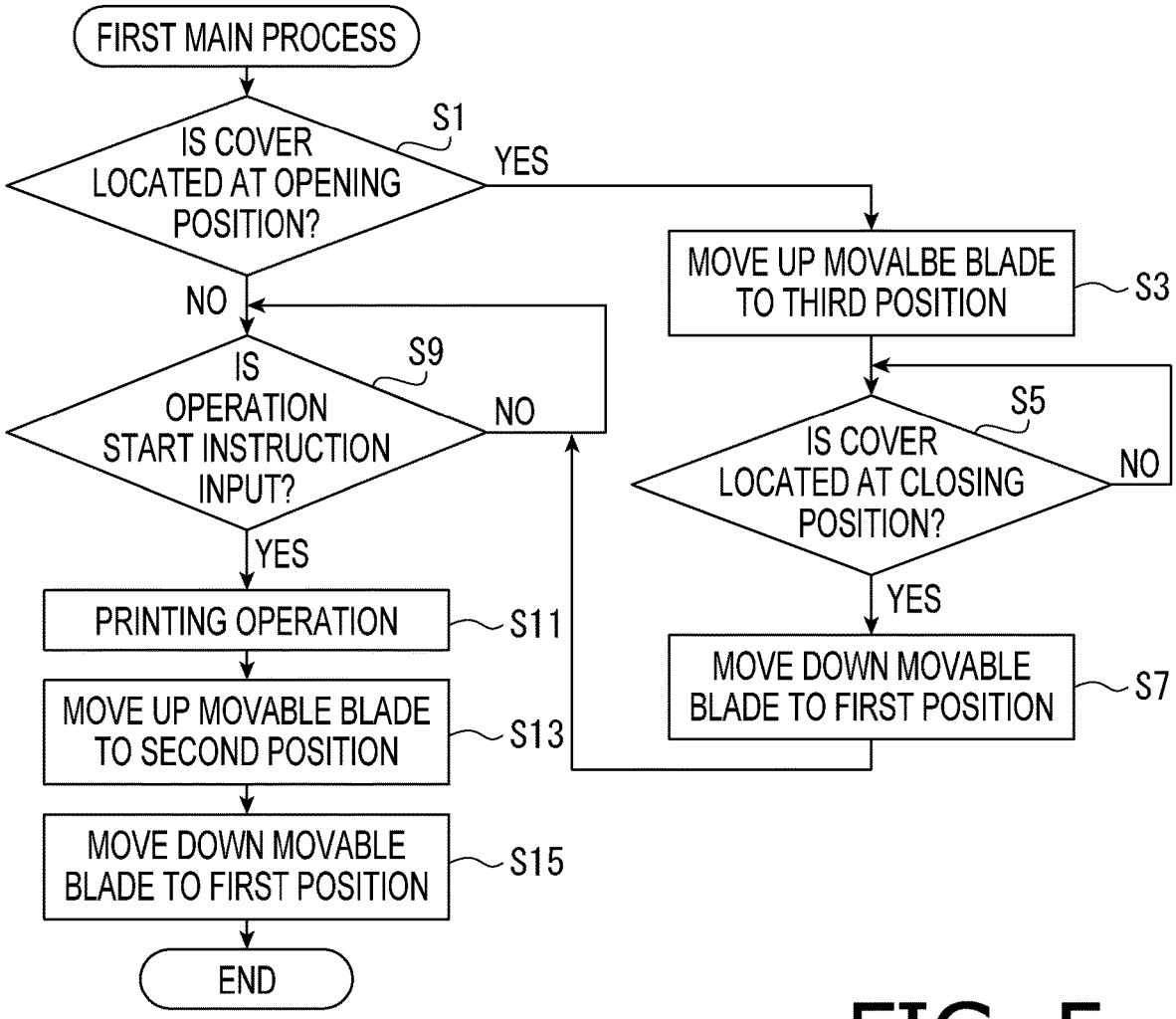
FIG. 5 is a flowchart illustrating a first main process.

As shown in FIGS. 2, 5 and 9, when the CPU 41 determines that the cover 3 is located at the closing position (S5: YES), the CPU 41 proceeds to S7. Then, the CPU 41 controls the cutting motor 91 to move down the movable blade 105 from the third position to the first position (S7). The CPU 41 determines whether an operation start instruction of the printer 1 is input (S9). Until the user inputs the operation start instruction (S9: NO), the CPU 41 stays in the standby state.

When the user input the operation start instruction through the operation panel 39 (S9: YES), the CPU 41 executes a printing operation (S11). For example, the CPU 41 controls the conveying motor 22 to rotate the platen roller 26 (FIG. 2B; arrow H). The platen roller 26 conveys frontward the roll paper 7 nipped between the platen roller 26 and the head 29. The roll paper 7 located on the guiding member 31 is conveyed toward the discharging port 32 located on a downstream side in the conveying direction with the lower surface being slidably contacted with the guide surface 31B. Further, the roll 8 rotates counterclockwise in right side view (FIG. 2A; arrow P), thereby the roll paper 7 being gradually delivered from the roll 8. At the same time, the CPU 41 drives the head 29. The head 29 executes printing with respect to the roll paper 7. The roll paper 7 to which printing has been executed is conveyed to the guide surface 31B through thee guide plate 23, and discharged outside the printer 1 through the discharging port 32. The CPU 41 stop driving the conveying motor 22 and the head 29 (S11).

The CPU 41 controls the cutting motor 9 to move the movable blade 105 from the first position to the second position (S13). After the movable blade 105 has passed the third position, the movable-side cutting tooth 106 and the stationary-side cutting tooth 104 nip the roll paper 7. Specifically, the first inclined blade part 106A nips, in association with the stationary-side cutting tooth 104, the roll paper 7 from a right part thereof toward a left side thereof, and the second inclined blade part 106B nips, in association with the stationary-side cutting tooth 104, the roll paper 7 from a left side part thereof toward a right side thereof. Thus, as the movable blade 105 moves up, cut lines are gradually made at both side ends of a width direction (i.e., the right-left direction) of the roll paper 7. When the movable blade 105 has reached the second position (see FIG. 9), the roll paper 7 is cut, along a cutting line extending in the width direction, by the movable blade 105 moving in the up-down direction in association with the stationary blade 101 and separated thereat. Then, the CPU 41 controls to stop the cutting motor 91 (S13).

The CPU 41 controls the cutting motor 91 to move down the movable blade 105 from the second position to the first position (S15). When the movable blade 105 has reached to the first position, the CPU 41 controls the cutting motor 91 to stop. Then, the CPU 41 terminates the first main process. The user can grasp the roll paper 7 cut out and discharged from the discharging port 32 and remove the same from the printer.

It is noted that, when the first main process is executed second time or later, the roll 8 has already been attached to the printer 1, it is unnecessary for the user to rotate the cover 3 to the opening position (S1: NO). Accordingly, the CPU 41 executes S1 and then S9-S15, and terminates the first main process.

As described above, the user manually moves the tip part 7A of the roll paper 7 to the guide surface 31B. At this stage, even when the curving property of the roll paper 7 is strong and the tip part 7A of roll paper 7 is curved downward, the tip par 7A of the roll paper 7 contacts the movable-side cutting tooth 106 of the movable blade 105 located at the third position and is supported thereby. Accordingly, the tip part 7A of the roll paper 7 can easily reach the guide surface 31B, and the user can set the roll paper 7 to the printer 1 easily and correctly. Further, the movable blade 105 located at the third position serves to forward the tip part 7A of the roll paper 7 from the guide plate 23 to the guide surface 31B. Therefore, it becomes unnecessary that the printer 1 has a dedicated component which prevents the tip part 7A of the roll paper 7 from being caught between the guide surface 31B and the movable blade 105. Thus, the printer 1 may have a simple structure and be downsized. As above, with a simple configuration, a small printer 1 in which the roll paper 7 can be set easily and correctly is realized.

As the right holder 9 is fitted in the groove 21 and contacts the attaching part 20 from the left side, the roll 8 is accommodated in the accommodating part 6 with positioning of the roll 8 in the right-left direction being adjusted. Therefore, a right end part of the roll paper 7 contacts the first inclined blade part 106A located at the third position without its position in the right-left direction being varied. Further, a position where the right end part of the roll paper 7 and the first inclined blade part 106A contact each other is higher than the guide surface 31B. Therefore, the tip part 7A of the roll paper 7 reaches the guide surface 31B further easily when the user manually move the tip part 7A of the roll paper 7 toward the guide surface 31B.

After the movable blade 105 is moved downward from the third position to the first position (S7), an operation mode of the printer 1 becomes a normal mode to execute the printing operation. At this stage, since the movable blade 105 is located at the first position, the roll paper 7 fed in association with the printing operation does not contact the movable-side cutting tooth 106 of the movable blade 105. Therefore, the movable blade 105 does not damage the roll paper 7 unnecessarily, and appearance of the roll paper 7 is maintained in an excellent condition.

When the user sets the roll paper 7 to the printer 1, the user rotates the cover 3 to be located at the opening position. In such a case, since the detector 11 outputs the OFF signal, the CPU 41 automatically determines that accommodation information, which is information representing that the roll 8 has been accommodated in the accommodating part 6, has been generated (S1: YES), and moves up the movable blade 105 to the third position (S3). Since the movable blade 105 is moved up to the third position in association with opening of the opening 6A of the accommodating part 6, convenience of the printer 1 is improved.

In the above description, the head 29 is an example of a printing part. The cutting motor 91 is an example of a driving part. The right holder 9 is an example of a one end part. The front-rear direction is an example of a conveying direction. The left direction is an example of a particular direction. The right side is an example of one side. The left side is an example of the other side.

Aspects of the present disclosures need not be limited to the above-described configuration of the illustrative embodiment, but may be modified in various ways. A shape of the movable-side cutting tooth 106 of the movable blade 105 may be configured to be asymmetrical in the right-left direction and may linearly incline from the right end to the left end, or may be parallel to the stationary-side cutting tooth 104 of the stationary blade 101 (i.e., non-inclined shape). In such a case, it is only required that the third position of the movable blade 105 may defined such that a part of or all of the movable-side cutting tooth 106 is higher than the lower end of the guide surface 31B.

The detector 11 may be, for example, a light-transmission type sensor arranged on the rear side with respect to the casing 12. In such a case, the detector 11 includes a light emitting element and a light receiving element which are arranged to face each other with a clearance therebetween. When the user rotates the cover 3 to the opening position, a part of the cover 3 advances between the light emitting element and the light receiving element, thereby the part of the cover 3 blocking the light emitted from the light emitting element to the light receiving element. With this configuration, the detector 11 transmits, for example, the ON signal to the CPU 41 instead of the OFF signal. In such a configuration, the detector 11 can detects whether the cover 3 covers or uncovers the opening 6A and generates a signal according to the detection result.

Figure 10:
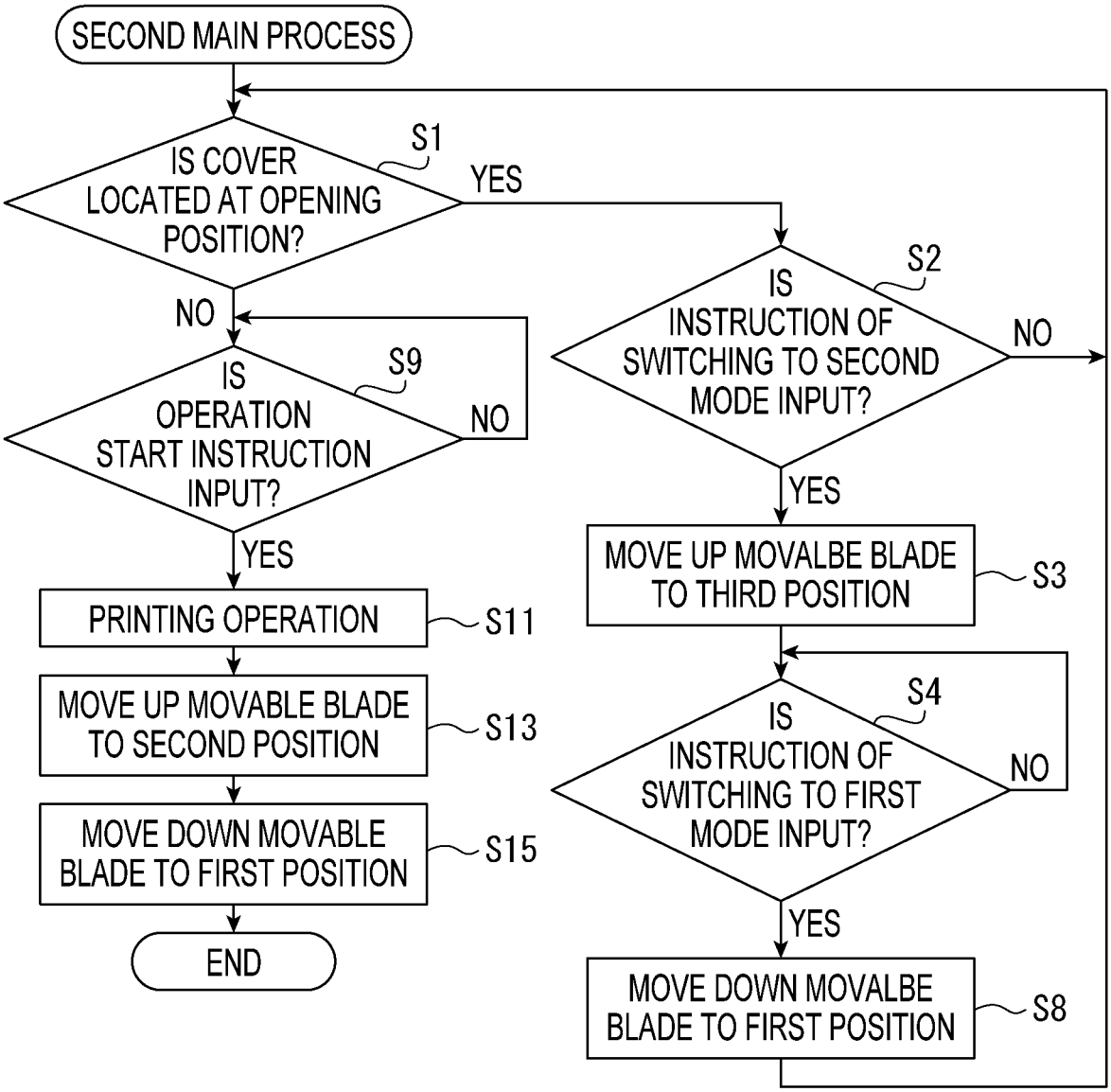
FIG. 10 is a flowchart illustrating a second main process.

Now, referring to FIG. 10, a second main process, which is a modification of the first main process, will be described. Steps the same as those in the first main process are assigned with the same step numbers in FIG. 10, and description on such steps will be simplified. Before the second main process is started, the roll 8 has not been attached to the printer 1, and the cover 3 is located at the closing position. When the user operates the operation panel 39 to power on the printer 1, the CPU 41 starts executing the second main process.

After the second main process is started, the user rotates the cover 3 to the opening position (S1: YES). The CPU 41 determines whether a mode switching instruction to switch the operation mode of the cutting motor 91 is switched from a first mode to a second mode has been input based on the detection result of the operation panel 39 (S2). The first mode is a mode for the normal operation, while the second mode is a mode when the roll 8 is accommodated in the accommodating part 6. When the CPU 41 does not detect the mode switching instruction within a particular period (e.g., within three seconds), the CPU 41 determines that the mode switching instruction has not been input (S2: NO), and the CPU 41 moves to S1. While the CPU 41 is repeatedly executing S1 and S2, the user may input the mode switching instruction through the operation panel 39. Then, the CPU 41 determines that the mode switching instruction to switch the operation mode of the cutting motor 91 from the first mode to the second mode has been input (S2: YES).

The CPU 41 moves up the movable blade 105 from the first position to the third position (S3). Thereafter, the CPU 41 determines whether the mode switching instruction to switch the operation mode of the cutting motor 91 from the second mode to the first mode has been input based on the detection result of the operation panel (S4). Until the mode switching instruction is detected (S4: NO), the CPU 41 pauses. During the paused state of the CPU 41, the user may accommodate the roll 8 in the accommodating part 6 and moves the tip part 7A to the discharging port 32. At this stage, since the movable blade 105 is located at the third position (see FIGS. 6 and 7), the tip part 7A is easily moved from the guide plate 23 to the guide surface 31B.

After the roll paper 7 has been attached to the printer 1, the user inputs the mode switching instruction to switch the operation mode from the second mode to the first mode through the operation panel 39 (S4: YES). The CPU 41 then controls the cutting motor 91 to move down the movable blade 105 from the third position to the first position (S8), and moves to S1. While the CPU 41 is repeatedly executing S1 and S2, the user may rotate the cover 3 from the opening position to the closing position. The CPU 41 determines that the cover 3 is not located at the opening position (S1: NO), and moves to S9. As the CPU 41 executes S9-S15 in order, the printer 1 executes the printing operation and the cutting operation with respect to the roll paper 7. After execution of S15, the CPU 41 terminates the second main process.

In the second main process, at a timing when the user input the mode switching instruction to switch the operation mode of the cutting motor 91 from the first mode to the second mode through the operation panel 39 (S2: YES), the CPU 41 automatically determines that the accommodation information has been generated, and moves up the movable blade 105 to the third position. Therefore, it becomes possible that the movable blade 105 can be moved up to the third position when the user desires. Accordingly, the usage convenience of the printer 1 is improved. It is noted that, in the modified embodiment, the CPU 41 executing S2 is an example of the determining part. Further, the CPU 41 executing S8 and S13 is an example of the normal controller.

What is claimed is:

1. A printer, comprising:

a casing having an accommodating part configured to accommodate a roll having a roll paper, as a printing medium, wound to form the roll, the casing having an opening through which the roll is attached to the casing;

a printing device configured to print an image on the roll paper;

a cutter configured to cut out the roll paper in a direction crossing a conveying direction of the roll paper; and a guide member arranged on a downstream side with respect to the cutter and configured to guide the roll paper toward a discharging port, a lower surface of the roll paper slidably contacting a guide surface of the guide member, wherein the cutter further includes:

a stationary blade formed to have a planar plate shape provided with a stationary-side cutting tooth at a lower end thereof, the stationary-side cutting tooth being located higher than the guide surface;

a movable blade formed to have a planar plate shape provided with a movable-side cutting tooth at an upper end thereof, the movable blade being configured to be movable, in an up-down direction with respect to the stationary blade, between a first position and a second position, the movable-side cutting tooth being located at a lower position than the guide surface when the movable blade is located at the first position, the movable-side cutting tooth being located at a higher position than the guide surface when the movable blade is located at the second position, wherein the printer further comprises:

a driving device configured to move the movable blade; and a controller configured to:

determine whether accommodation information indicating that the roll is accommodated in the accommodating part has been generated; and cause the driving device to move the movable blade to a third position when the controller determines that the accommodation information has been generated, the third position being a position between the first position and the second position, at least a part of the movable-side cutting tooth being located at a higher position than the guide surface when the movable blade is located at the third position.

2. The printer according to claim 1, wherein the guide surface of the guide member is formed to be a planar surface;

wherein the stationary-side cutting tooth linearly extends in a particular direction which intersects with the conveying direction and is parallel to the guide surface, wherein the movable-side cutting tooth includes:

a first inclined blade part configured to incline downward from one side end to another side end in the particular direction; and a second inclined blade part connected to a lower end of the first inclined blade part and configured to incline upward from the one side end to the other side end in the particular direction, wherein the accommodating part is configured to contact an end of one side of the roll accommodated in the opening to adjust a position of the roll in the particular direction, and wherein, when the movable blade is located at the third position, the first inclined blade part contacts one side end part of the roll paper at a position higher than the guide surface.

3. The printer according to claim 1, wherein the controller is configured to:

move up the movable blade from the first position to the third position; and control the driving device to move the movable blade located at the third position to the first position after the movable blade has been moved to the third position, and further control the driving device to move the movable blade from the first position to the second position after printing operation by the printing device is finished.

4. The printer according to claim 1, further comprising:

a cover configured to open and close the opening of the accommodating part; and a detector configured to detect whether the cover closes or opens the opening and generate a signal depending on a result of detection, wherein the controller determines whether the signal generated by the detector and indicating that the cover opens the opening is generated as the accommodation information.

5. The printer according to claim 1, further comprising an operation panel to be operated by a user, the operation panel being configured to generate a mode switching instruction instructing an operation mode of the printer to switch from a first mode to a second mode in accordance with an operation by the user, the first mode being a mode when the printer is normally used, the second mode being a mode when the roll paper is accommodated to the opening, wherein the controller is configured to determine whether the mode switching instruction is generated as the accommodation information.

* * * * *